US007399113B2

(12) United States Patent
Konietzko

(10) Patent No.: US 7,399,113 B2
(45) Date of Patent: Jul. 15, 2008

(54) ARRANGEMENT TO PRODUCE RECIPE MIXTURES

(76) Inventor: Albrecht Konietzko, Oberer Stephansberg 49 g, Bamberg (DE) 96049

( * ) Notice: Subject to any disclaimer, the term of this patent is extended or adjusted under 35 U.S.C. 154(b) by 411 days.

(21) Appl. No.: 11/137,712

(22) Filed: May 25, 2005

(65) Prior Publication Data

US 2006/0087915 A1 Apr. 27, 2006

(30) Foreign Application Priority Data

May 26, 2004 (DE) ..... 20 2004 008 573

(51) Int. Cl.
*B01F 7/00* (2006.01)

(52) U.S. Cl. ..... 366/279; 366/328.1; 366/328.3; 366/329.1

(58) Field of Classification Search ..... 366/189, 366/195, 196, 194, 328.3, 328.1, 330.1, 329.1, 366/279

See application file for complete search history.

(56) References Cited

U.S. PATENT DOCUMENTS

| | | | | |
|---|---|---|---|---|
| 4,176,797 | A * | 12/1979 | Kemp | 366/316 |
| 4,758,096 | A * | 7/1988 | Gunnarsson | 366/139 |
| 4,799,801 | A * | 1/1989 | Bruning | 366/255 |
| 4,952,065 | A * | 8/1990 | Kreuziger | 366/195 |
| 5,328,262 | A * | 7/1994 | Lidgren et al. | 366/139 |
| 5,397,178 | A * | 3/1995 | Konietzko | 366/197 |
| 5,490,727 | A * | 2/1996 | Poschl | 366/316 |
| 5,797,728 | A * | 8/1998 | Frith | 366/316 |
| 5,829,875 | A * | 11/1998 | Hagel et al. | 366/189 |
| 2003/0103410 | A1* | 6/2003 | Scheying | 366/195 |
| 2006/0087915 | A1* | 4/2006 | Konietzko | 366/279 |
| 2006/0109737 | A1* | 5/2006 | Wilander | 366/189 |

FOREIGN PATENT DOCUMENTS

| | | | |
|---|---|---|---|
| DE | 42 16 252 | A1 | 11/1993 |
| DE | 197 35 539 | A1 | 2/1999 |
| EP | 0 920 907 | A2 | 6/1999 |
| EP | 1 038 796 | A2 | 9/2000 |

OTHER PUBLICATIONS

EPO Search report for EP 1600206, Feb. 2006, 3 pages.*

* cited by examiner

*Primary Examiner*—Tony G Soohoo
(74) *Attorney, Agent, or Firm*—Mayer & Williams PC; Mark D. Wieczorek, Esq.; Stuart H. Mayer, Esq.

(57) ABSTRACT

The invention relates to an assembly to produce recipe mixtures, with a variable-speed agitator drive, a mixing chamber (1) whose capacity is matched to the desired quantity of recipe mixture and that is enclosed by a lid (9), and an agitator tool (2). The mixing chamber (1) and the agitator tool (2) may move with respect to each other along the axis of the drive shaft during the production of the recipe mixture. The agitator tool (2) may be driven by means of a drive shaft (15) that may be inserted through a sealable central aperture (11) of the mixing chamber. The agitator tool (2) possesses friction surface areas such that the material is drawn into the spaces between its ends and the opposing inner surfaces of the mixing chamber (1).

17 Claims, 4 Drawing Sheets

ARRANGEMENT TO PRODUCE RECIPE MIXTURES

Figure 1:
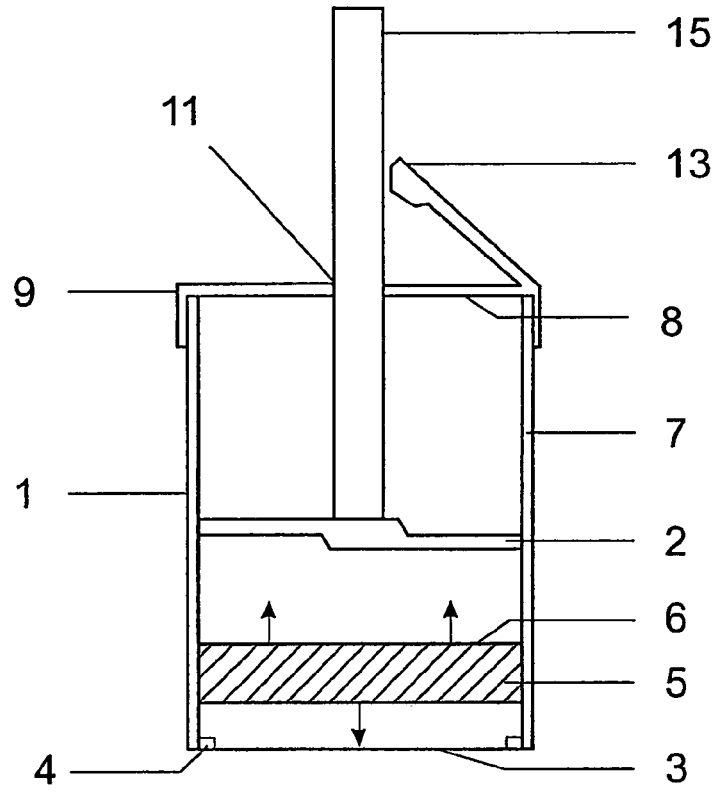

The present innovation relates to an arrangement to produce recipe mixtures that includes an agitator, a mixing vessel, and a mixing tool driven by the agitator.

From EP 0 920 907 B1 a cylindrical mixing and dosing container for pharmaceutical, cosmetic, or comparable products is known that includes a closeable drain in its bottom. The open end opposite the bottom is configured to receive a piston that is mounted within the container body so that it may move. The piston serves as both a guide for the drive shaft of the mixing tool and as a dosing device that is moveable by means of a dosing assembly. After completing the mixing process, the agitator shaft is separated from the mixing tool and removed from the container through the piston guide. To remove the mixed material, the dosing unit is placed onto the container, whereby a threaded spindle of the dosing unit is connected to the piston. When this threaded spindle is rotated, the piston is moved toward the drain fitting, thus allowing dosing. The extraction process described is complicated, and cannot be simplified, since a separate dosing unit is required in any case to extract the finished recipe mixture.

A container to store paste or fluid masses may be taken from EP 1 038 796 A2. The container body described includes a piston mounted within it so that it may move that divides the container body into a pressurized air section and an airtight supply section separated from it. For extraction, pressurized air is fed into the pressurized air section, thus causing displacement of the piston into the supply section and the mass to flow through a supply opening. The extraction process described is also rather complicated. A supply element must always be available which provides the required pressurized air for the extraction process.

DE 197 35 539 A1 contains an agitator device in which the agitator tool that remains in the agitator vessel may be placed into use at any time. For this, the dimensions of the agitator vessel, the agitator tool, and the drive end of the agitator rod are so matched to one another that the agitator tool may be released from its at-rest position when the agitator rod is inserted into the agitator vessel, and when it is removed, can be locked into its at-rest position. In order to achieve adequate mixing results, a relatively long operating time is required for this agitator device.

An arrangement with an agitator to mix pharmaceutical and/or cosmetic salves, pastes, crèmes, gels, or emulsions may be taken from DE 42 16 252 C2. Relatively good mixing results may be achieved using this known arrangement, but the mixing process itself requires a lot of time.

It is thus the task of this innovation to present an arrangement to produce recipe mixtures that leads to clear improvement in the quality of the recipe mixtures produced in spite of reduced operating time. Extraction of the end product should be possible in a simple manner.

This task is solved by the arrangement described in Patent claim 1.

The advantage to this innovative arrangement is the fact that mixing vessel and mixing tool are so matched to each other that the friction contact between mixing vessel and mixing tool required for high-quality production exists, along with the fact that effective material induction between mixing vessel and mixing tool is ensured in order to achieve optimum mixing of various recipe components. In comparison with conventional solutions, a qualitatively better mixing result may be achieved using the innovative arrangement with simultaneous reduction in production time.

In a particularly advantageous embodiment, the mixing tool is equipped with two agitator wings that are attached to the drive shaft along its axis so that they overlap. The agitator wings are implemented as flat, essentially oval surfaces tapering toward the outer frontal end, within the rotation plane. A hole-type recess or aperture through the agitator wing is provided in each agitator wing. The agitator wing surfaces facing toward the top or bottom of the mixing vessel are so inclined along the rotation direction in their outer frontal area that the material thickness decreases toward the edge of the mixing tool. The agitator wing surfaces following each of these surfaces are so inclined in the rear area with regard to the rotational direction that the material thickness decreases toward the aperture.

This configuration of the mixing tool enables particularly thorough blending of the components of the recipe mixture. The outer agitator wing surfaces facing toward the top or bottom of the mixing vessel have the function of material induction between the adjacent mixing tool and the mixing vessel section, i.e., bottom or top. Subsequently following agitator wing surfaces act upon areas perpendicular to the agitator wing main plane of extension and opposite the inner surfaces of the mixing vessel to perform the desired material induction. During the mixing process, these oblique surface areas of the agitator wings create flow relationships that lead to strong turbulence in the material being mixed.

The broadened surfaces of the mixing tool near the drive shaft ensure that the material being mixed is drawn into the center of the mixing tool and simultaneously receives a push toward the axis of the drive shaft. The concentration of pushing force acting on the material being mixed toward the center optimizes material induction by the mixing tool with respect to the opposing mixing vessel inner surface area. Simultaneously, these broadened surfaces reduce undesired introduction of air bubbles into the material being mixed.

The hole-type recess in the agitator wings ensures firm contact by the end areas of the agitator wings with the mixing vessel inner surface under production-dictated tolerances of the mixing vessel by means of elastic giving and rebounding. Second, it is ensured that the spreading function on the inducted material to be mixed remains effective. Elastic deposit onto the inner surface of the mixing vessel further enables quiet running of the mixing tool within the mixing vessel. While the arc-shaped end areas rest elastically against the inner surface of the mixing vessel at rest, they spring back elastically from the pressure of the material inducted.

The tapering of the mixing tool toward its edge leads to a considerable reduction in the energy required to drive the agitator. The approximately symmetrical shape of the mixing tool can avoid the noisy oscillating of a hard-working unsymmetrically-shaped mixing tool. This leads to significant reduction in the operating noise level during recipe production, which is very advantageous in apothecaries since customer conversation must be understood.

According to an advantageous embodiment example, the agitator wing surfaces facing the top or bottom of the mixing vessel are matched to the shape of the inner surface of the top or bottom. This configuration achieves uniform material induction between the end area of the mixing tool and the inner surface of the mixing space.

According to a useful embodiment example, the mixing vessel possesses a bottom that is displaceable within the mixing vessel. The displaceable bottom serves for the extraction of the material being mixed. Multiple openings in the top to extract, with concomitant disadvantageous contamination of the material being mixed, may thus be avoided. Using the displaceable bottom, volumetric compensation may be performed if the quantity of the material being mixed is less than the volume of the mixing vessel. Simultaneously, the air is largely forced out of the mixing vessel in this manner.

A threaded crock with a cylindrical crock body is preferably used that includes an exterior thread onto which a lid may be screwed. The threaded crock also possesses a displaceable bottom whose outer edge is transformed into a sliding ring. The threaded crock further possesses a bottom opening with an inner ring that serves as a stop for the displaceable bottom. The threaded crock simultaneously serves as an output vessel, whereby decanting of the produced mixture may be avoided.

A crock is the conventional designation in apothecaries for salve storage or dispensing vessels, preferably in the realm of recipe mixtures. Today, crocks are made of plastic, and are available in volumes of 10, 20, 30, 50, 75, 100, 150, 200, 250, 300, 500, or 1,000 ml. For hygienic reasons, crocks may only be used a single time for medicines, and may not be taken back and refilled. They are thus disposable vessels whose simultaneous use as a preparation vessel is of particular advantage.

Mixing of recipe components within a closed system occurs largely while sealed from ambient air. Decanting of the produced recipe from a large mixing vessel into small dispensing vessels is not required because the mixing vessel simultaneously serves as the dispensing vessel.

There are two advantageous embodiments of the mixing vessel. In the first advantageous embodiment, the lid of the mixing vessel is provided with a central opening to receive the drive shaft. In this case, the central opening serves simultaneously as the extraction opening. A second advantageous embodiment provides the central opening to receive the drive shaft in the displaceable bottom. In this embodiment, an additional, sealable extraction opening is required in the lid. In expanded embodiment examples, various adaptors and applicators may be attached to the extraction opening. Thus, the material being mixed may be well dosed and accurately inserted into body openings.

Figure 2:
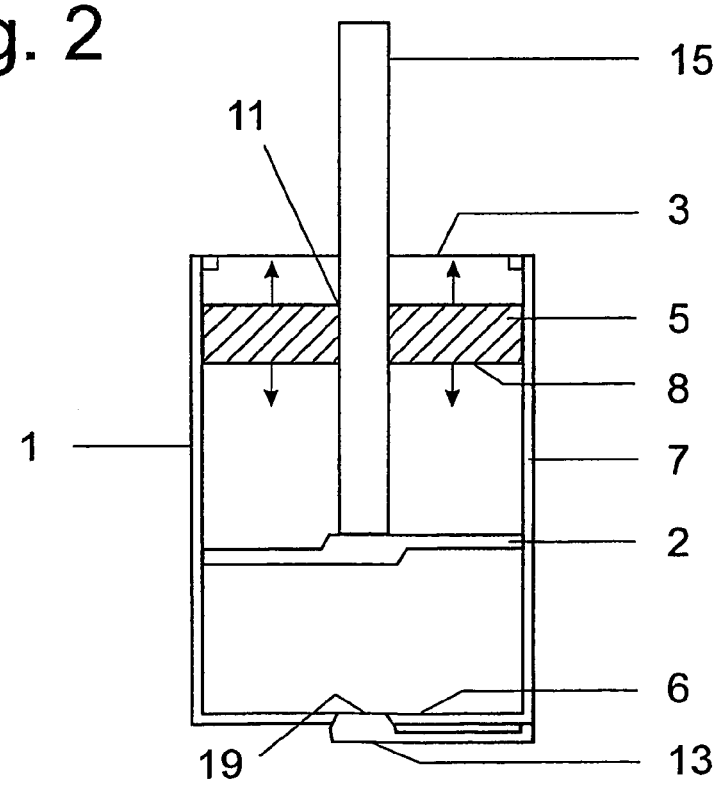
Figure 3:
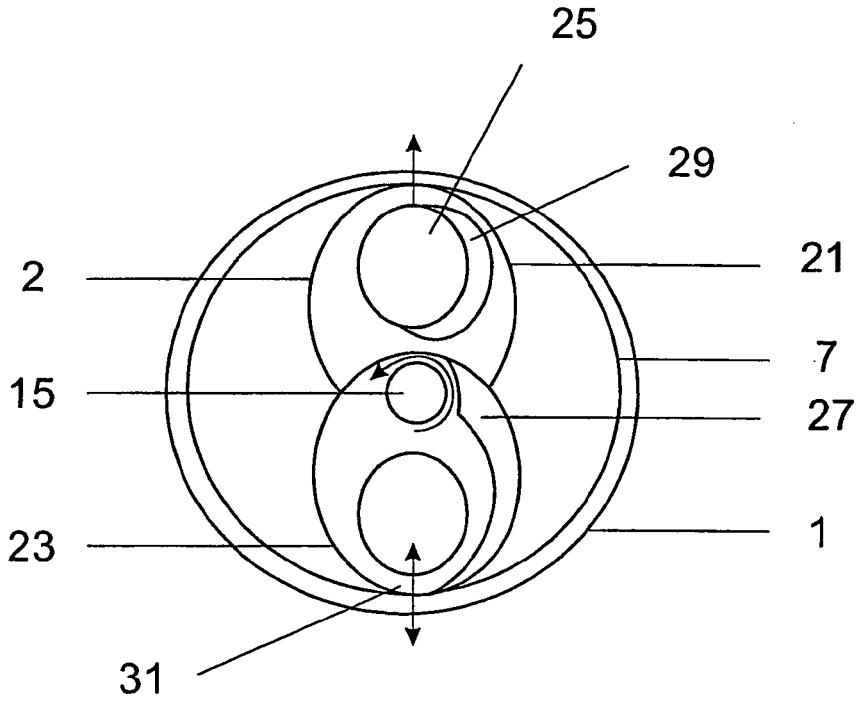
Figure 4:
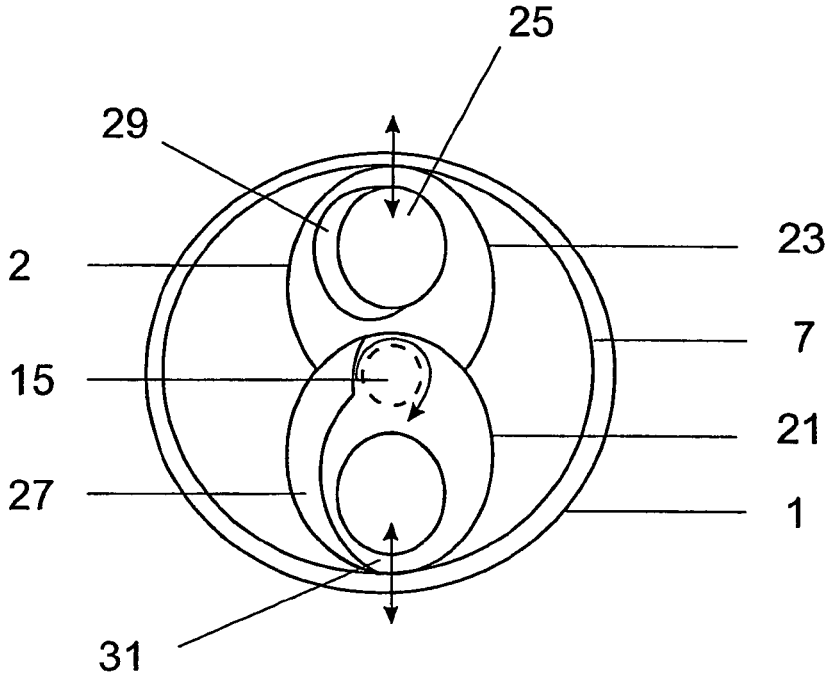
Figure 5:
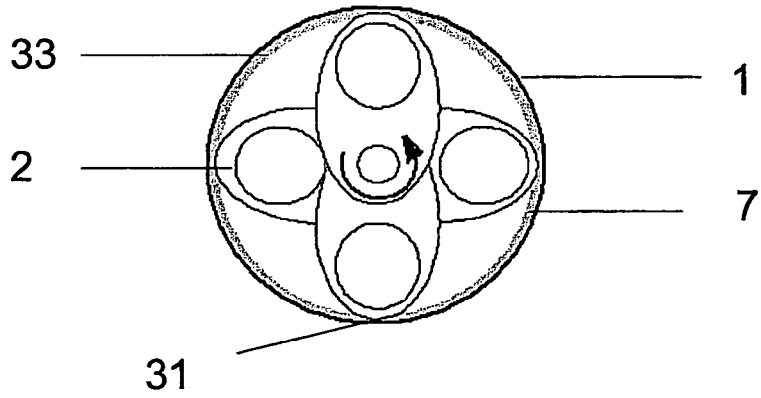
Figure 6:
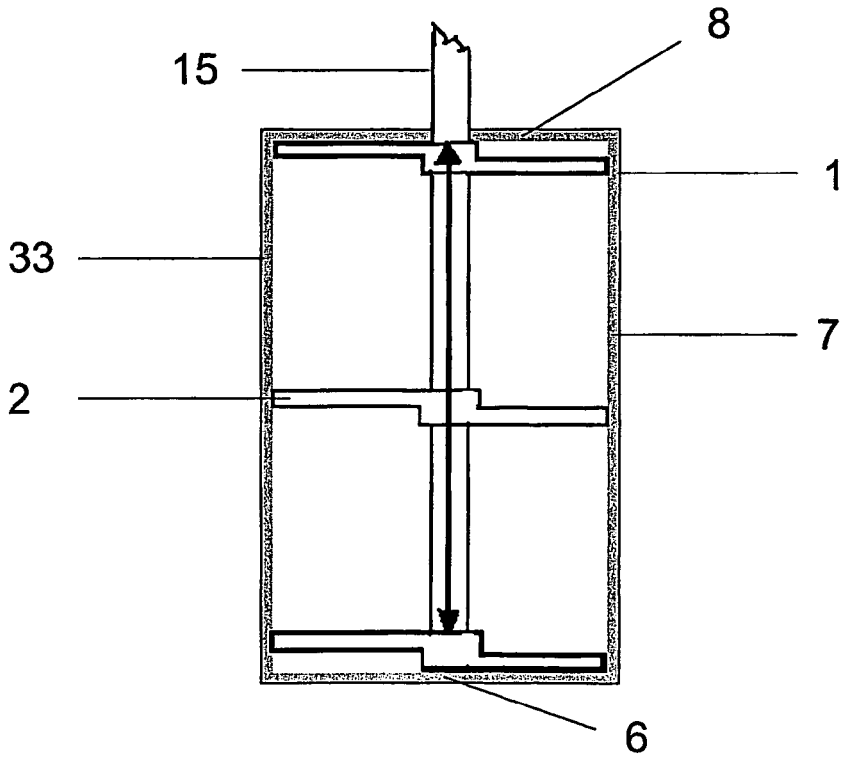
Figure 7:
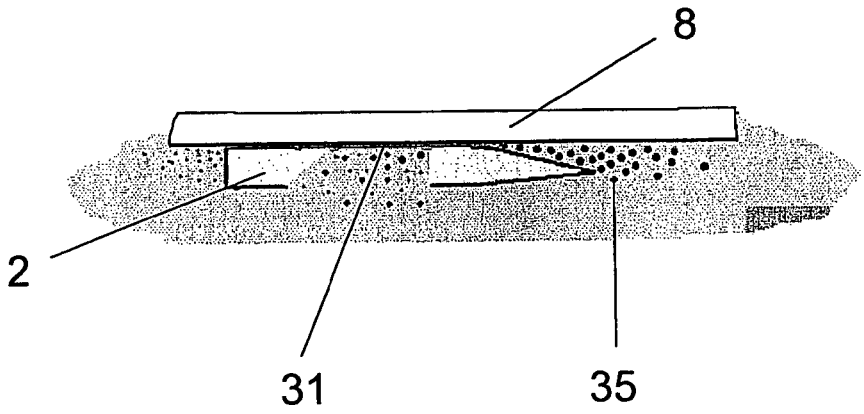
Figure 8:
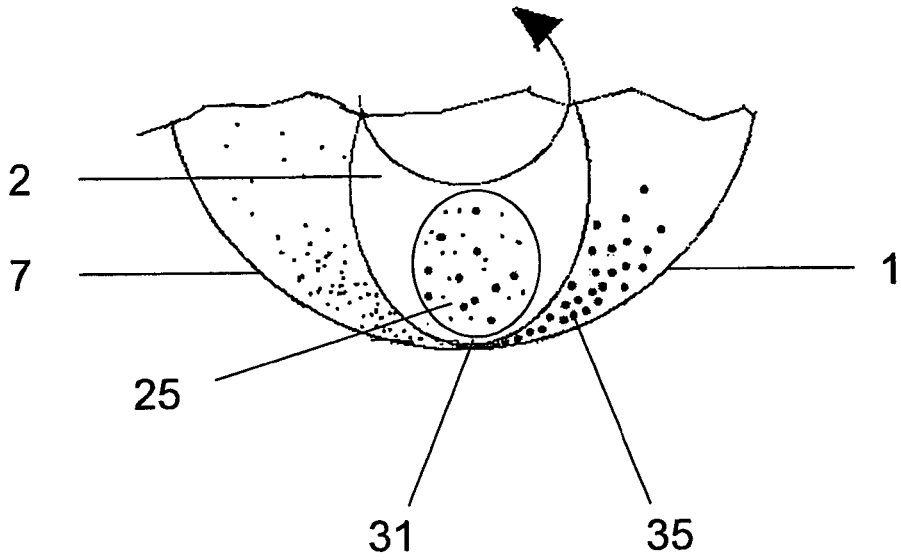

Further advantages, details, and expansions of the present invention result from the following description of advantageous embodiment examples with reference to the Figures, which show:

FIG. 1 a simplified longitudinal cross-section view of a first embodiment example of a mixing vessel with mixing tool;

FIG. 2 a simplified longitudinal cross-section view of a second embodiment example of the mixing vessel with mixing tool;

FIG. 3 a cross-section view of the mixing tool from above;

FIG. 4 a cross-section view of the mixing tool from below;

FIG. 5 a cross-section view of the interior space of the mixing vessel during the mixing process;

FIG. 6 a longitudinal cross-section view of the interior space of the mixing vessel during the mixing process;

FIG. 7 a detailed view of the end areas of the agitator wings while resting against the second inner surface of the limiters of the mixing vessel;

FIG. 8 a detailed view of the end areas of the agitator wings while resting against inner wall areas of the mixing vessel.

FIG. 1 shows a simplified longitudinal cross-section view of a first embodiment example of a mixing vessel 1 with a mixing tool 2. The mixing vessel 1 is a cylindrical threaded crock. In the bottom of the threaded crock is a bottom opening 3 in which a stop, for example in the form of an inner ring 4 is included. A displaceable bottom 5 may move within the threaded crock. The displaceable bottom 5 includes on its outer edge a slide ring acting as a gasket (not shown). The bottom 5 may be pressed upward without difficulty through the bottom opening 3. Its outer edge seals against the inner wall 7 of the threaded crock 7.

The upper area of the threaded crock 1 is provided with an external thread. A lid 9 whose edge is provided with an internal thread is screwed onto this external thread. There is a central opening 11 in the lid 9 that may be sealed using a sealing stopper 13 after the agitator tool 2 has been removed. The central opening 11 also serves as the extraction opening for the finished mixed product. The cylindrical mixing chamber available for mixing extends between a lower inner surface 6 and an upper inner surface 8.

The mixing tool 2 is attached on the end of the drive shaft 15 so that it may not rotate. The drive shaft 15 is inserted through the central opening 11 into the mixing vessel 1 for agitation. The drive shaft 15 is connected at its other end to an adjustable-speed electrical motor (not shown) that provides rotation for the entire arrangement. Suitable transmission and clutch elements are interposed in the conventional manner.

Attention is drawn to the fact that drive shaft and mixing tool may be either permanently or temporarily attached to each other. In specific embodiment examples, the mixing tool may be configured as a lost element, and may remain within the mixing vessel after completion of the agitation process. In this case, the threaded crock need no longer be opened since only the drive shaft must be taken out of the central opening.

FIG. 2 shows a simplified longitudinal cross-section view of a second embodiment example of the mixing vessel 1 with the mixing tool 2. The mixing vessel 1 is again implemented as a circular cylinder with a displaceable bottom 5 within it. The displaceable bottom 5 may be removed from the mixing vessel 1 in order to add the recipe components. The central opening 11 is located in this embodiment example in the displaceable bottom 5. The drive shaft 15 on whose end the mixing tool 2 is attached is inserted through this central opening 11. An extraction opening 19 that may be sealed by a sealing stopper 13 is positioned on the side of the mixing vessel opposite the displaceable bottom 5.

FIG. 3 shows a cross-section illustration of the mixing tool in a view from above.

FIG. 4 shows the same mixing tool in a view from below. The mixing tool in this illustrated embodiment example is a winged agitator 2 with two agitator wings 21, 23 mounted offset from one another along the axial direction that are attached with overlap near the drive shaft. The agitator wings 21, 23 are implemented as flat disks that are essentially oval in the plane of rotation which are tapered on their outer edges. There is an aperture or hole-type recess in each agitator wing 21, 23. The outer agitator wing surfaces of the two agitator wings 21, 23 facing the top or bottom are so inclined at their front area 27 with respect to the rotation direction that the material thickness decreases toward the outer edge. The surfaces of the opposing sides of the agitator wings 21, 23 are so inclined at their rear area 29 of the hole-type recess 25 that the material thickness decreases toward the recess 25. The arc-shaped end areas 31 of the agitator wings 21, 23 rest elastically against the inner wall 7 of the mixing vessel 1.

The agitator wings facing the top or bottom of the mixing vessel are preferably matched to the shape of the inner surfaces 6, 8 of the top or bottom. Thus, intensive material induction may be achieved between these inner surfaces and the mixing tool 2.

Both agitator wings 21, 23 are provided with areas 27, 29. The areas 27 promote material induction along the axial direction of the drive shaft between the mixing tool 2 and the adjacent mixing vessel section during the mixing process. Depending on the shape of the mixing vessel (depending on whether the drive shaft is inserted into the mixing vessel through the bottom or the lid), this adjacent section may be the bottom 5 or the lid 9. The areas 29 cause material induction on each opposing inner surface of the mixing vessel.

Before the actual mixing process, as much air as possible is first forced out of the mixing vessel 1 by displacing the bottom 5 (see displacement arrows in FIGS. 1 and 2). This measure largely allows exclusion of air bubbles and undesired air contents and oxidation. The mixing process is begun at low speed that is gradually increased for salves with solid component particles to the optimum speed dependent on the size of the mixing vessel 1. The proper speed is generally between 500 and 1,200 revolutions per minute (RPM) for the start phase, and up to 3,000 RPM for production. Rotational direction is preferably as shown by the round arrow in FIGS. 3 and 4.

A valuable and simple embodiment example of the agitator provides an oscillating guide for the mixing vessel by hand. In improved agitators, the mixing vessel is raised and lowered using a hoisting device automatically or at an adjustable rhythm. It is equally suitable to raise and lower the mixing tool within a fixed mixing vessel.

After completion of the mixing process, the drive shaft 15, including the mixing tool 2 as necessary, is removed and cleaned before the next mixing process by means of a stream of hot water, or by simple wiping with cellulose. In order to decrease cleaning expense, there is also the option of separating the mixing tool 2 from the drive shaft 15 and only to clean these items, while the relatively valuable mixing tool 2 either remains within the mixing vessel 1 or is removed and discarded. The central opening 11 is sealed, preferably by means of a sealing stopper 13 attached to the mixing vessel.

To extract the material being mixed, the sealing stopper 13 is removed from the central or extraction opening. Extraction of the material being mixed may preferably be performed by means of simple displacement of the bottom with moderate finger pressure. Extraction aids often used with liquid material being mixed help with apportioning. Suitable applicators may be used for pinpoint use on or in small or large body openings. The applicators regulate the extrusion quantity, thus ensuring efficient and secure dosing.

Preferably for mixing vessels with large diameter and height so great that the displaceable bottom can no longer be reached by the user's thumb; a pump or rotational mechanism may be employed as a pushing or extraction aid. These aids simplify the decanting of stock manufactured mixed product into small dispensing vessels of the types described above. If the bottom of the dispensing vessel has been previously pushed close to the lid, and if both extraction openings are coupled together using an adapter, the closed production system may remain closed to the atmosphere all the way to the patient. The patient removes the mixed product such as a salve hygienically as from a tube that is considered to be a reference package for salve with regard to multiple hygienic extractions. Subsequently, these dispensing vessels may also be filled and sealed air-free during highly technical salve production using an adapter.

FIG. 5 shows a cross-section view of the interior space of the mixing vessel during the mixing process. The mixing tool 2 is shown at two different points in time, displaced by about 90° rotationally. The material induction areas 33 are located on the inner wall 7 of the mixing vessel 1. The material is inducted during the mixing process by the rotating mixing tool 2 in these areas between mixing tool 2 and inner wall 7.

FIG. 6 shows a longitudinal cutaway view of the mixing vessel interior space during the mixing process. Three positions of the mixing tool at various times are shown, at which the mixing tool 2 is resting in the upper or lower position against the upper or lower inner or limiting surfaces 6, 8 of the mixing vessel. During mixing, material induction occurs between these upper or lower limiting surfaces 6, 8 of the mixing vessel and the mixing tool 2. Since the agitator wing surfaces facing the limiting surfaces 6, 8 of the mixing vessel are preferably matched to these limiting surfaces, uniform material induction is achieved.

Further, FIG. 6 shows another point in time of the mixing process with the mixing tool shown in the center of the mixing vessel 1. As was shown in FIG. 5, material induction occurs in the areas between mixing tool 2 and inner wall 7 standing perpendicular to the main extension plane during the entire mixing process.

FIG. 7 shows a detailed view of the end areas 31 of the agitator wings while they are resting against the upper inner surface 8. As mentioned above, material induction occurs between mixing tool 2 and upper inner surface 8 when the mixing tool is placed into its uppermost position. FIG. 7 also shows the effect of this material induction on dispersion of the inducted agglomerated material 35.

FIG. 8 is a detailed view of the end area 31 of the agitator wings while resting against the inner wall areas 7 of the mixing vessel 1. One may see that arc-shaped end area 31 while at rest against the inner wall 7 of the mixing vessel 1 bends back from the pressure of the inducted material 35, and thus allows induction of the exterior material.

ILLUSTRATION REFERENCE LIST

1—Mixing vessel
2—Mixing tool
3—Bottom opening
4—Inner ring
5—Displaceable bottom
6—Lower inner surface
7—Inner wall
8—Upper inner surface
9—Top/Lid
11—Central opening
13—Sealing stopper
15—Drive shaft
19—Extraction opening
21—Agitator wing
23—Agitator wing
25—Hole-shaped recess
27—Forward outer area of the agitator wing along the rotation direction
29—Rearward area of the agitator wing along the rotation direction
31—Arc-shaped end area of the agitator wing
33—Material induction area
35—Inducted material

The invention claimed is:

1. An arrangement to produce recipe mixtures, comprising:

a mixing vessel sealable by a lid, whose size is matched to the quantity of the recipe mixture: and a mixing tool driven by a drive shaft passing through a sealable central opening of the mixing vessel that possesses friction surfaces that rest against or could rest against at least one inner surface of the mixing vessel under friction pressure, the drive shaft drivable by an adjustable speed motor, wherein the mixing vessel and the mixing tool my move with respect to each other along the axial direction of the drive shaft during manufacture of the recipe mixture, and wherein the mixing tool is a winged agitator with two agitator wings that are displaced with respect to each other along the axial direction and that overlap near the drive shaft, and wherein each of the agitator wings includes flat oval surfaces as seen in their plane of rotation tapering toward their distal ends, in each of which a recess is formed that penetrates the agitator wing, and wherein sides of the agitator wing facing away from each other in a forward area with respect to the rotation direction are inclined with regard to the plane of the other agitator wing, and include reduced material thickness toward the outer edge, and wherein sides of the winged agitator facing each other in the rearward area of the recess with respect to the rotation direction are inclined with regard to the plane of the other agitator wing, and include reduced material thickness toward the outer edge.

2. The Arrangement of claim 1, wherein the mixing vessel includes a displaceable bottom within the mixing vessel.

3. The Arrangement of claim 2, wherein the mixing vessel is a threaded crock with a cylindrical crock body and includes a lid that may be screwed onto it, further comprising a displaceable bottom within the crock body that possesses a sliding ring at its outer edge and that rests against the bottom opening of the crock body, wherein the threaded crock may also be used simultaneously as a dispensing vessel.

4. The Arrangement of claim 3, wherein the mixing tool is attached to the drive shaft in a removable fashion.

5. The Arrangement of claim 2, wherein the mixing tool is attached to the drive shaft in a removable fashion.

6. The Arrangement of claim 1, wherein the mixing vessel is a threaded crock with a cylindrical crock body and includes a lid that may be screwed onto it, further comprising a displaceable bottom within the crock body that possesses a Sliding ring at its outer edge and that rests against the bottom opening of the crock body, wherein the threaded crock may be used simultaneously as a dispensing vessel.

7. The Arrangement as in claim 6, wherein the lid is provided with a central opening that serves as the extraction opening.

8. The Arrangement of claim 7, wherein the mixing tool is attached to the drive shaft in a removable fashion.

9. The Arrangement as in claim 6, wherein the displaceable bottom is provided with a central opening, and that a side of the mixing vessel opposite the displaceable bottom includes a sealable extraction opening.

10. The Arrangement of claim 9, wherein the mixing tool is attached to the drive shaft in a removable fashion.

11. The Arrangement of claim 6, wherein the mixing tool is attached to the drive shaft in a removable fashion.

12. The Arrangement of claim 1, wherein the mixing tool is attached to the drive shaft in a removable fashion.

13. An arrangement to produce recipe mixtures, comprising:

a mixing vessel sealable by a lid, whose size is matched to the quantity of the recipe mixing; and a mixing tool driven by a drive shaft passing through a sealable central opening of the mixing vessel that possesses friction surfaces that rest against or could rest against at least one inner surface of the mixing vessel under friction pressure, the drive shaft drivable by an adjustable speed motor, wherein the mixing vessel and the mixing tool may move with respect to each other along the axial direction of the drive shaft during manufacture of the recipe mixture, and wherein the mixing tool is a winged agitator with two agitator wings that are displaced with respect to each other along the axial direction and that overlap near the drive shaft, and wherein each of the agitator wings includes flat oval surfaces as seen in their plane of rotation tapering toward their distal ends, in each of which a recess is formed that penetrates the agitator wing, and wherein sides of the agitator wings facing away from each other in a forward area with respect to the rotation direction are inclined with regard to the plane of the other agitator wing, and include reduced material thickness toward the outer edge, and wherein sides of the winged agitator facing each other in the rearward area of the recess with respect to the rotation direction are inclined with regard to the plane of the other agitator wing, and include reduced material thickness toward the outer edge, and wherein the mixing vessel includes a displaceable bottom within the mixing vessel.

14. The Arrangement of claim 13, wherein the mixing tool is attached to the drive shaft in a removable fashion.

15. An arrangement to produce recipe mixtures, comprising:

a mixing vessel sealable by a lid, whose size is matched to the quantity of the recipe mixture; and a mixing tool driven by a drive shaft passing through a sealable central opening of the mixing vessel that possesses friction surfaces that rest against or could rest against at least one inner surface of the mixing vessel under friction pressure, the drive shaft drivable by an adjustable speed motor, wherein the mixing vessel and the mixing tool may move with respect to each other along the axial direction of the drive shaft during manufacture of the recipe mixture, and wherein the mixing tool is a winged agitator with two agitators wings that are displaced with respect to each other along the axial direction and that overlap near the drive shaft, and wherein each of the agitator wings includes flat oval surfaces as seen in their plane of rotation tapering toward their distal ends, in each of which a recess is formed that penetrates the agitator wing, and wherein sides of the agitator wing facing away from each other in a forward area with respect to the rotation direction are inclined with regard to the plane of the other agitator wing, and include reduced material thickness toward the outer edge, and wherein sides of the winged agitator facing each other in the rearward area of the recess with respect to the rotation direction arc inclined with regard to the plane of the other agitator wing, and include reduced material thickness toward the outer edge, and wherein the mixing vessel is a threaded crock with a cylindrical crock body and includes a lid that may be screwed onto it, further comprising a displaceable bottom within the crock body that possesses a sliding ring at its outer edge and that rests against the bottom opening of the crock body, wherein the threaded crock may also be used simultaneously as a dispensing vessel.

16. The Arrangement of claim 15, wherein the mixing tool is attached to the drive shaft in a removable fashion.

17. An arrangement to produce recipe mixtures, comprising:

a mixing vessel sealable by a lid, whose size is matched to the quantity of the recipe mixture; and a mixing tool driven by a drive shaft passing through a sealable central opening of the mixing vessel that possesses friction surfaces that rest against or could rest against at least one inner surface of the mixing vessel under friction pressure, the drive shaft drivable by an adjustable speed motor, wherein the mixing vessel and the mixing tool may move with respect to each other alone the axial direction of the drive shaft during manufacture of the recipe mixture, and wherein the mixing tool is a winged agitator with two agitator wines that are displaced with respect to each other alone the axial direction and that overlap near the drive shaft, and wherein each of the agitator wings includes flat oval surfaces as seen in their plane of rotation tapering toward their distal ends, in each of which a recess is fanned that penetrates the agitator wing, and wherein sides of the agitator wine facing away from each other in a forward area with respect to the rotation direction are inclined with regard to the plane of the other agitator wing, and include reduced material thickness toward the outer edge, and wherein sides of the winged agitator facing each other in the forward area of the recess with respect to the rotation direction arc inclined with regard to the plane of the other agitator wing, and include reduced material thickness toward the outer edge, and wherein the mixing tool is attached to the drive shaft in a removable fashion.

* * * * *